US007337640B1

(12) United States Patent
Linden et al.

(10) Patent No.: US 7,337,640 B1
(45) Date of Patent: Mar. 4, 2008

(54) PROPELLER REPAIR APPARATUS

(76) Inventors: Gary J. Linden, 480 E. 14th St., Dubuque, IA (US) 52001; John G. Linden, 837 Stoneridge Pl., Dubuque, IA (US) 52001

( * ) Notice: Subject to any disclaimer, the term of this patent is extended or adjusted under 35 U.S.C. 154(b) by 145 days.

(21) Appl. No.: 11/315,980

(22) Filed: Dec. 22, 2005

(51) Int. Cl.
*B21D 5/01* (2006.01)

(52) U.S. Cl. ..... 72/31.02; 72/293; 72/383; 72/453.02; 72/455

(58) Field of Classification Search ..... 72/31.02, 72/293, 381, 383, 386, 453.02, 455
See application file for complete search history.

(56) References Cited

U.S. PATENT DOCUMENTS 2,558,845 A * 7/1951 Gruetjen ..... 72/398
2,742,947 A * 4/1956 Dobbs ..... 72/316
3,032,092 A * 5/1962 Erlbacher ..... 72/293
4,161,056 A 7/1979 Dunham
4,222,259 A 9/1980 Junes
4,527,410 A 7/1985 MacNitt, Jr. et al.
5,315,856 A 5/1994 Mackey
5,377,521 A 1/1995 Mackey
5,713,233 A * 2/1998 McCarthy et al. ..... 72/31.02

OTHER PUBLICATIONS

Propstraightener.com web pages (10 pages).

* cited by examiner

*Primary Examiner*—David B Jones
(74) *Attorney, Agent, or Firm*—Quarles & Brady LLP

(57) ABSTRACT

A propeller repair apparatus suitable for repairing and changing the pitch of a propeller includes a first rail parallel to and spaced from a second rail. A tapered shaft extends upwardly between the first and second rails for mounting a propeller thereon. A first frame extending between the first and second rails is movably mounted on the first and second rails for movement along the first and second rails. In one embodiment, a first actuator is pivotally mounted to the first frame and includes an extendible ram engagable with a propeller mounted on the tapered shaft.

18 Claims, 11 Drawing Sheets

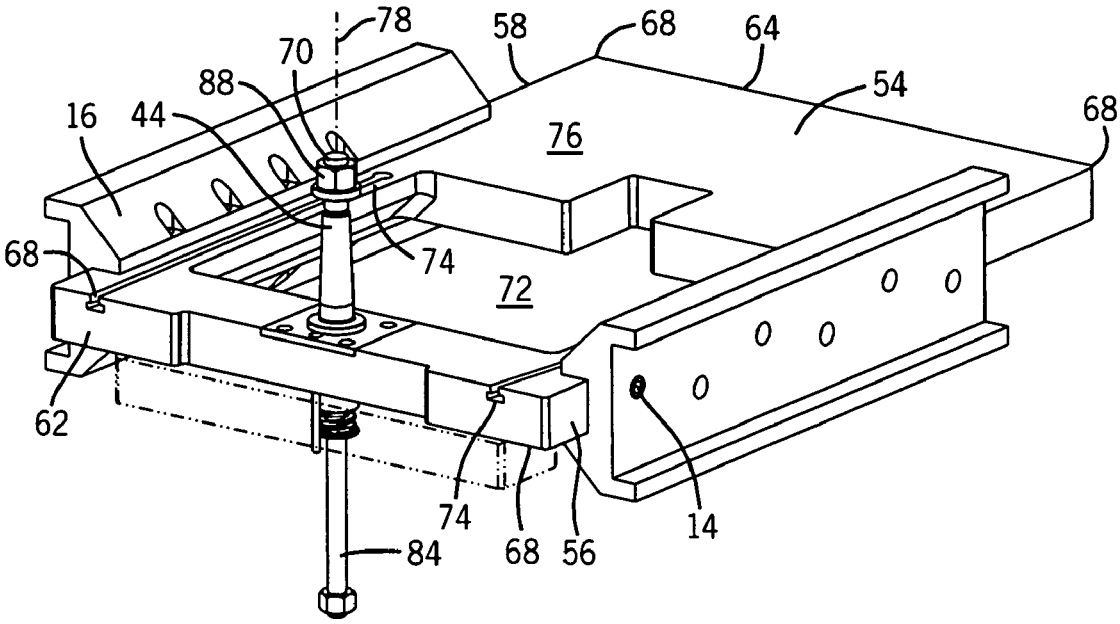
FIG. 12
FIG. 13
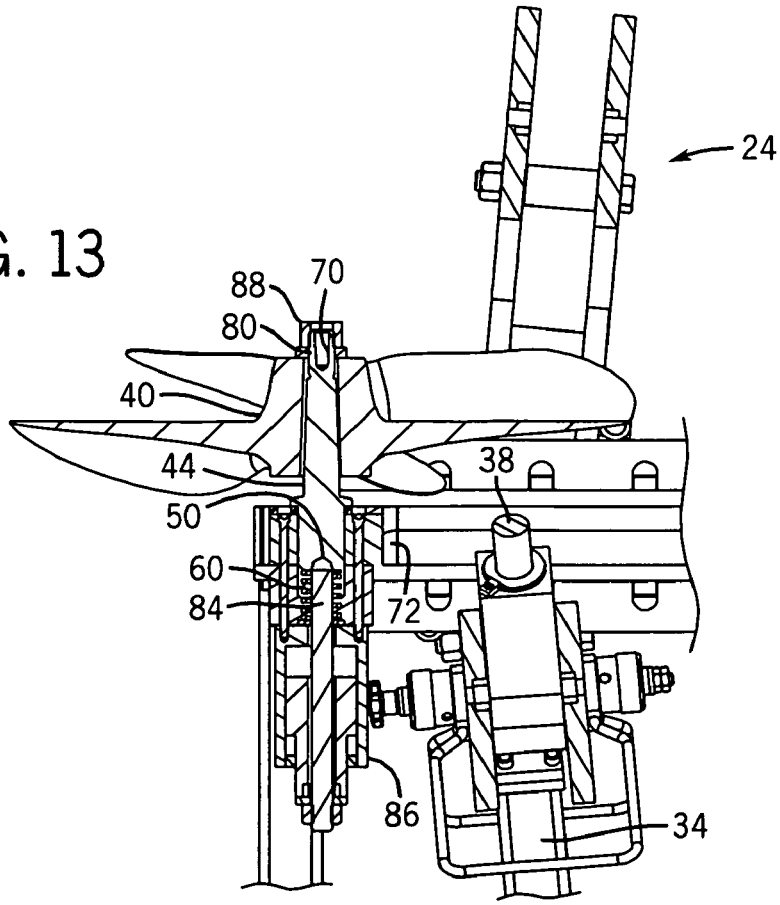

PROPELLER REPAIR APPARATUS

CROSS REFERENCES TO RELATED APPLICATIONS

Not Applicable.

STATEMENT REGARDING FEDERALLY SPONSORED RESEARCH

Not Applicable.

TECHNICAL FIELD

This invention relates to propeller repair equipment, and in particular to a propeller repair apparatus including at least one actuator having a ram engagable with a propeller and mounted on a movable frame.

DESCRIPTION OF THE BACKGROUND ART

Marine propellers are often damaged during use by striking objects in the water, such as rocks, lake bed bottoms, and the like. Moreover, the performance of a marine propeller can be changed by modifying the pitch of the blades of a propeller. Repairing a propeller or changing the pitch of a propeller blade often requires bending a portion of the blade a desired amount. This is often accomplished by pounding on the blade using a hammer. Unfortunately, using a hammer can impart too much or too little force on the blade resulting in too much or too little bending. As a result, repairing a blade or changing the blade shape using a hammer is often a long a tedious process requiring a great deal of trial an error.

One known apparatus, disclosed in U.S. Pat. No. 5,315,856, incorporates an arbor press having a single actuator that can be used to bend a very large propeller blade still affixed to a ship. The arbor applies a constant force to the propeller blade. Unfortunately, this particular apparatus is of little use for blades forming part of smaller propellers, such as propellers having a diameter less than 42 inches, or propellers that have been removed from the vessel.

Another known apparatus incorporates opposing actuators that are movable in both X and Y directions. The opposing actuators, however, extend in parallel directions only. Thus limiting the direction of the forces that can be imparted onto the propeller blade. A complex system that simultaneously rotates the opposing actuators about the propeller attempts to overcome this deficiency. Unfortunately, the complex system significantly increases the cost and complexity of this apparatus. Accordingly, a need exists for a propeller repair apparatus that is simple and inexpensive, yet can impart non-parallel opposing forces on propeller blade.

SUMMARY OF THE INVENTION

The present invention provides a simple propeller repair apparatus suitable for repairing and changing the pitch of a propeller. The apparatus includes a first rail parallel to, and spaced from, a second rail. A tapered shaft extends upwardly between the first and second rails for mounting a propeller thereon. A first frame extending between the first and second rails is movably mounted on the first and second rails for movement along the first and second rails. In one embodiment, a first actuator is pivotally mounted to the first frame and includes an extendible ram engagable with a propeller mounted on the tapered shaft.

A general objective of the present invention is to provide a simple propeller repair apparatus that can impart a controlled force on a propeller blade. This objective is accomplished by providing a propeller repair apparatus having an actuator that imparts a controlled force on the propeller blade.

Another objective of the present invention is to provide a simple propeller repair apparatus that can impart a force on a propeller blade from multiple directions. This objective is accomplished by mounting the actuator on a frame that is movable relative to the propeller, and in one embodiment, the actuator is pivotable relative to the frame.

The foregoing and other objectives and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims herein for interpreting the scope of the invention.

BRIEF SUMMARY OF THE DRAWINGS

FIG. 12 is a rear, right perspective view of the work platform of FIG. 1;

FIG. 13 is a sectional view along line 13-13 of FIG. 1;

DETAILED DESCRIPTION OF THE PREFERRED EMBODIMENTS

Figure 1:
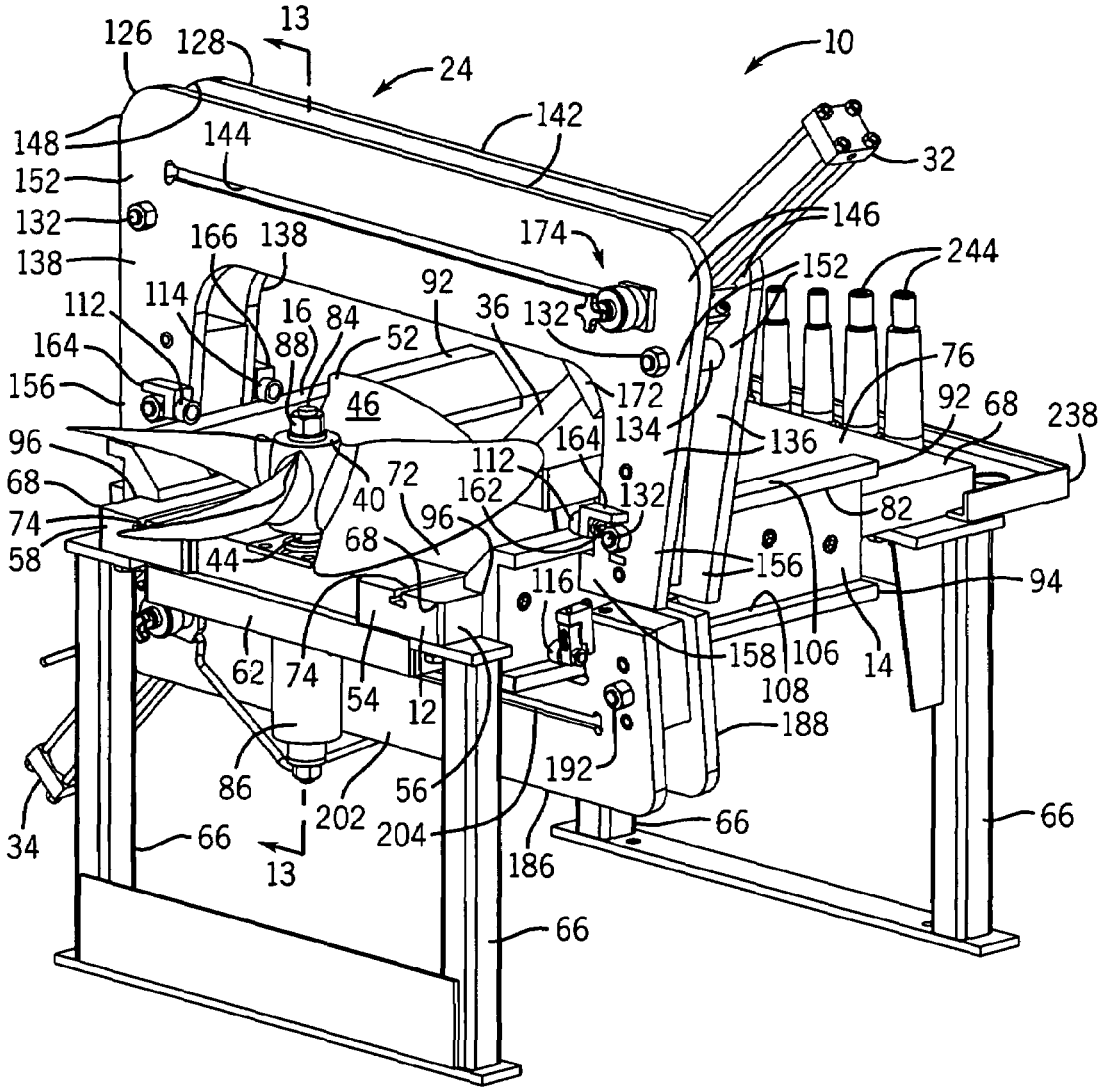
FIG. 1 is a rear, right end perspective view of a propeller repair apparatus incorporating the present invention.
Figure 2:
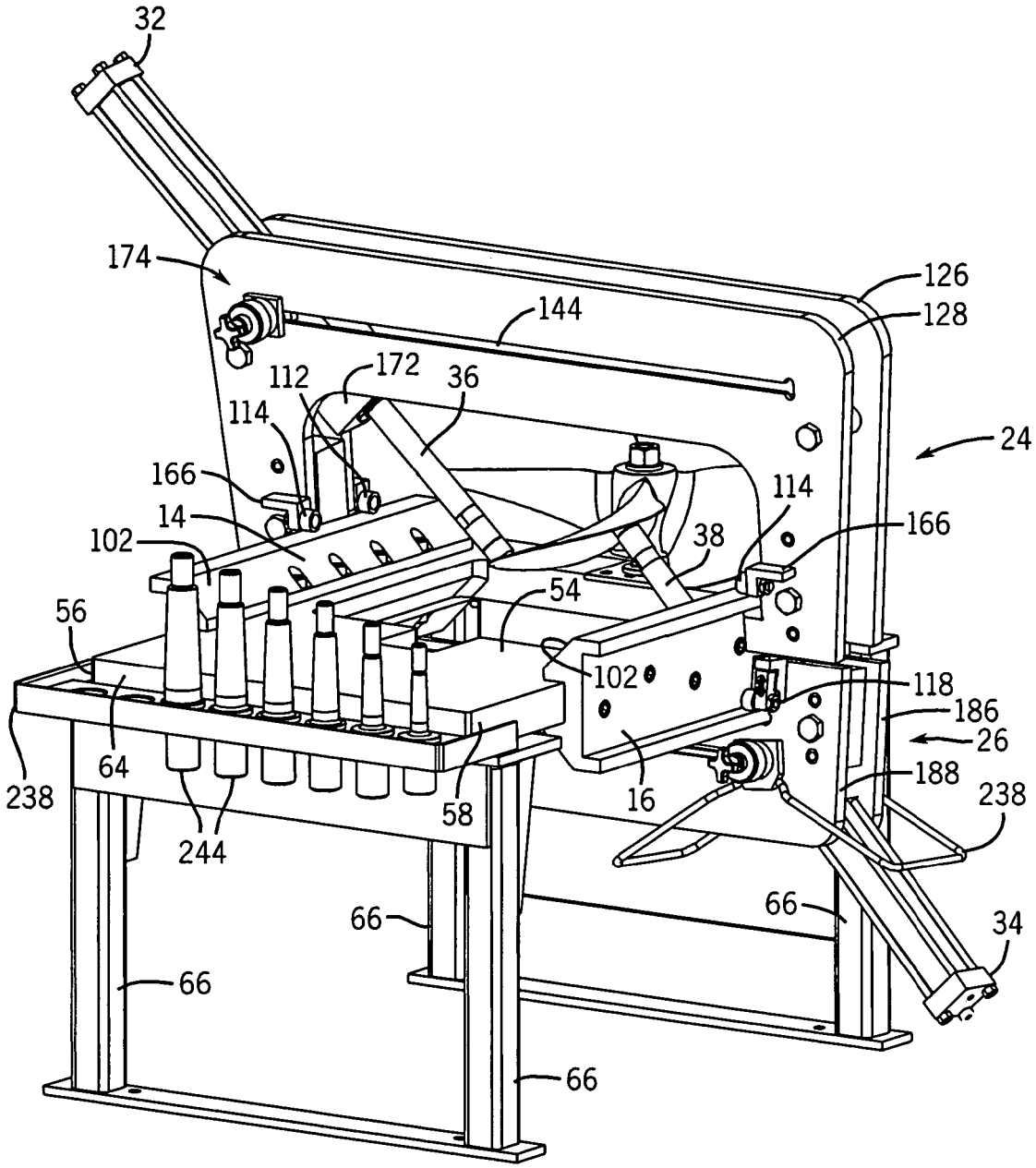
FIG. 2 is a front, left end perspective view of the apparatus of FIG. 1.
Figure 3:
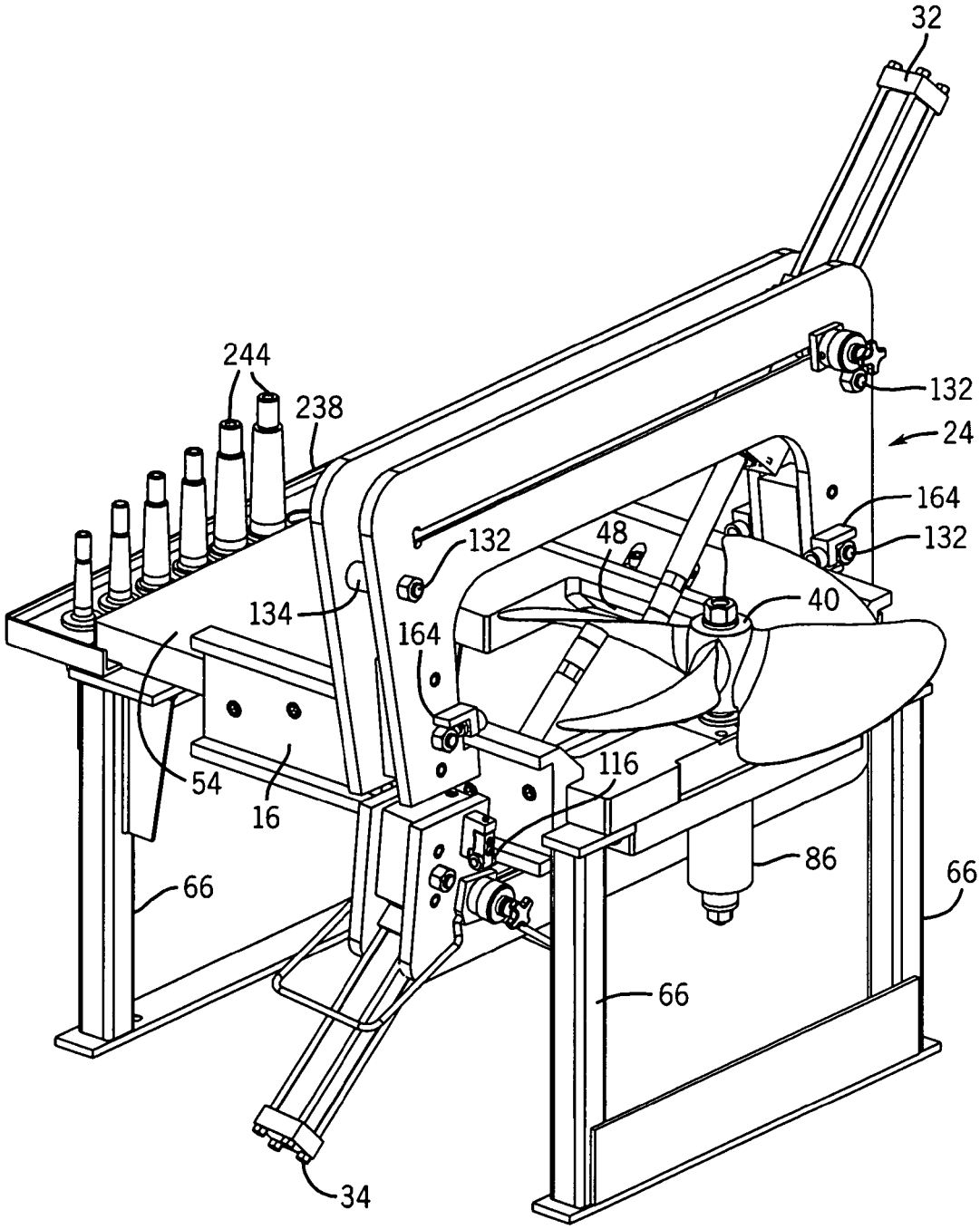
FIG. 3 is a front, right end perspective view of the apparatus of FIG. 1.
Figure 4:
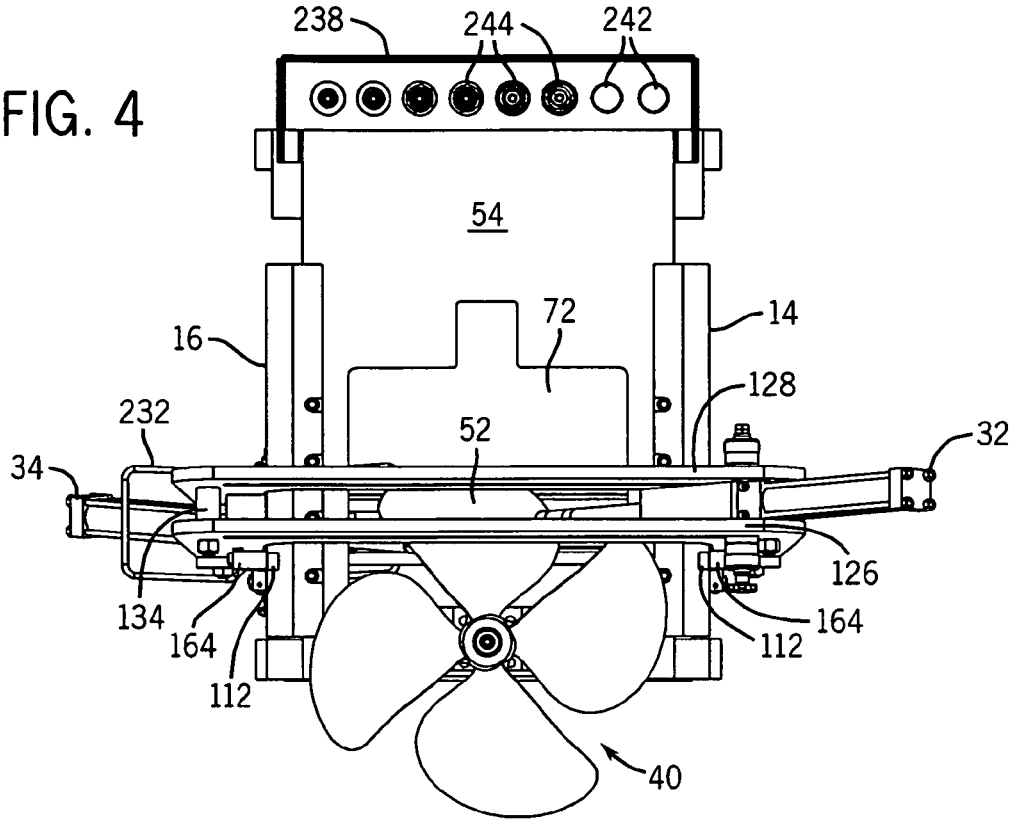
FIG. 4 is a top view of the of the apparatus of FIG. 1.
Figure 5:
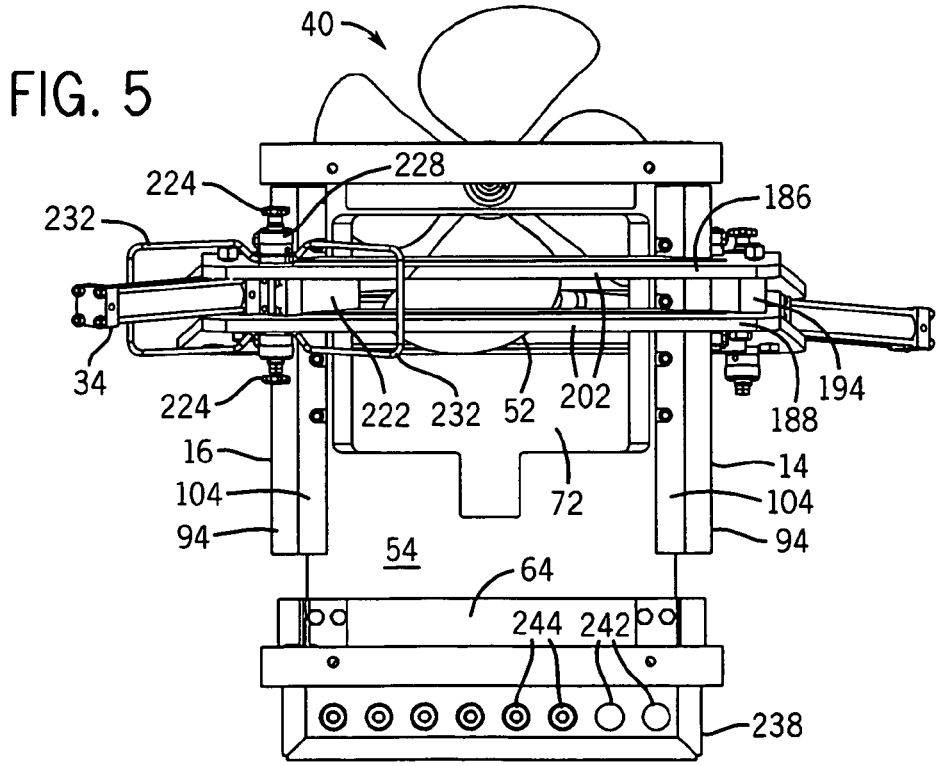
FIG. 5 is a bottom view of the apparatus of FIG. 1.
Figure 6:
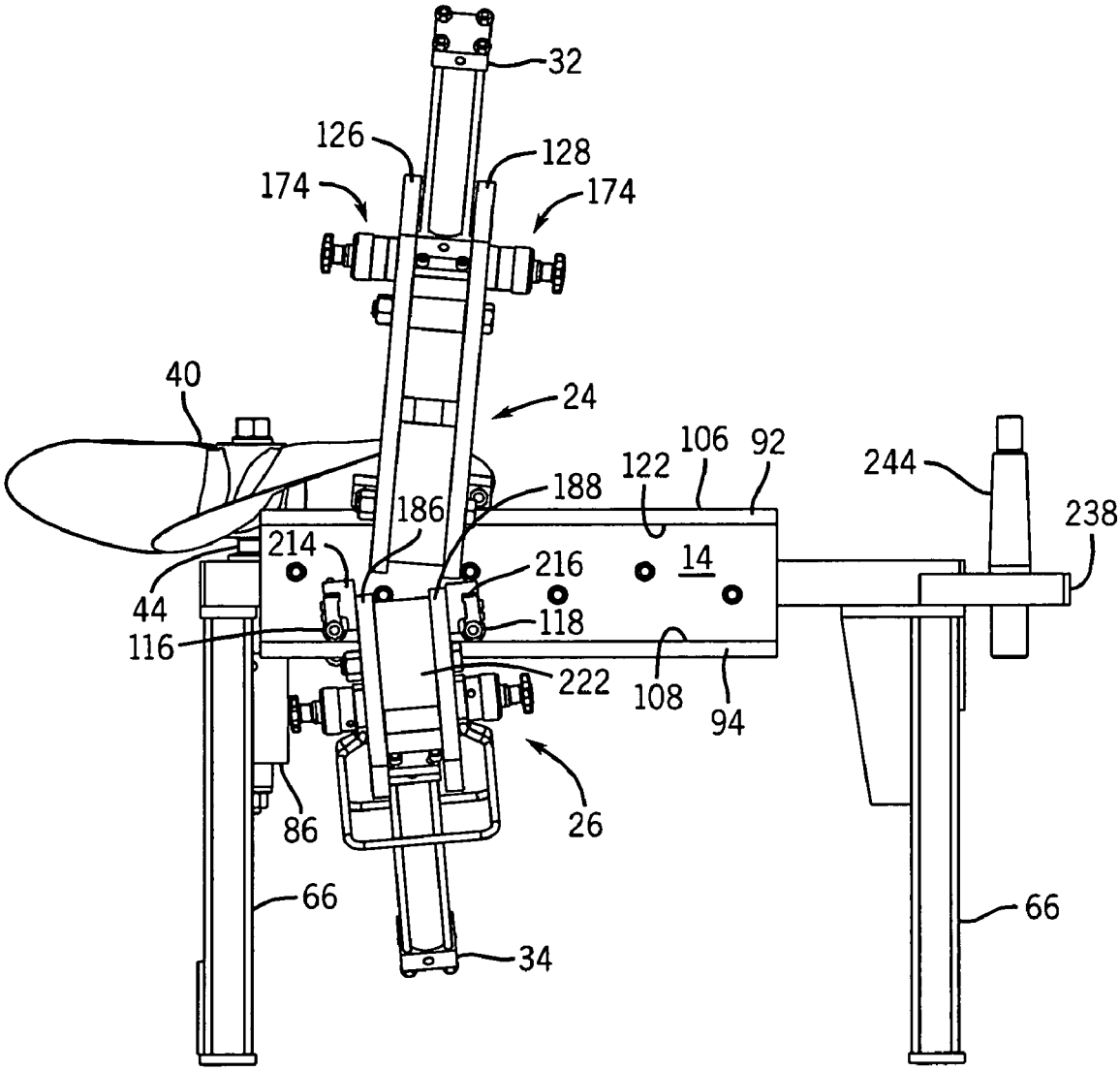
FIG. 6 is a rear view of the apparatus of FIG. 1.
Figure 7:
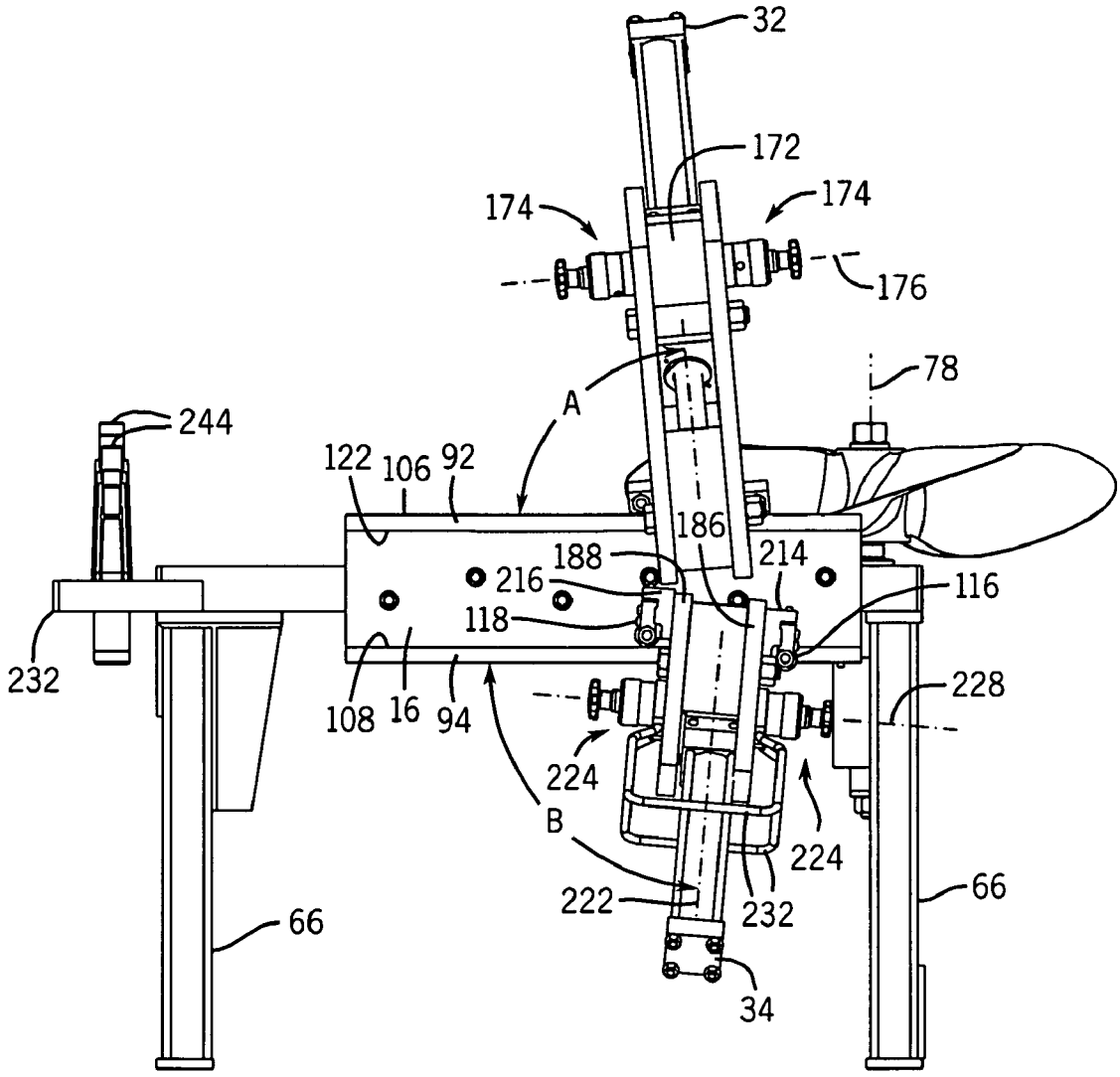
FIG. 7 is a front view of the apparatus of FIG. 1.
Figure 8:
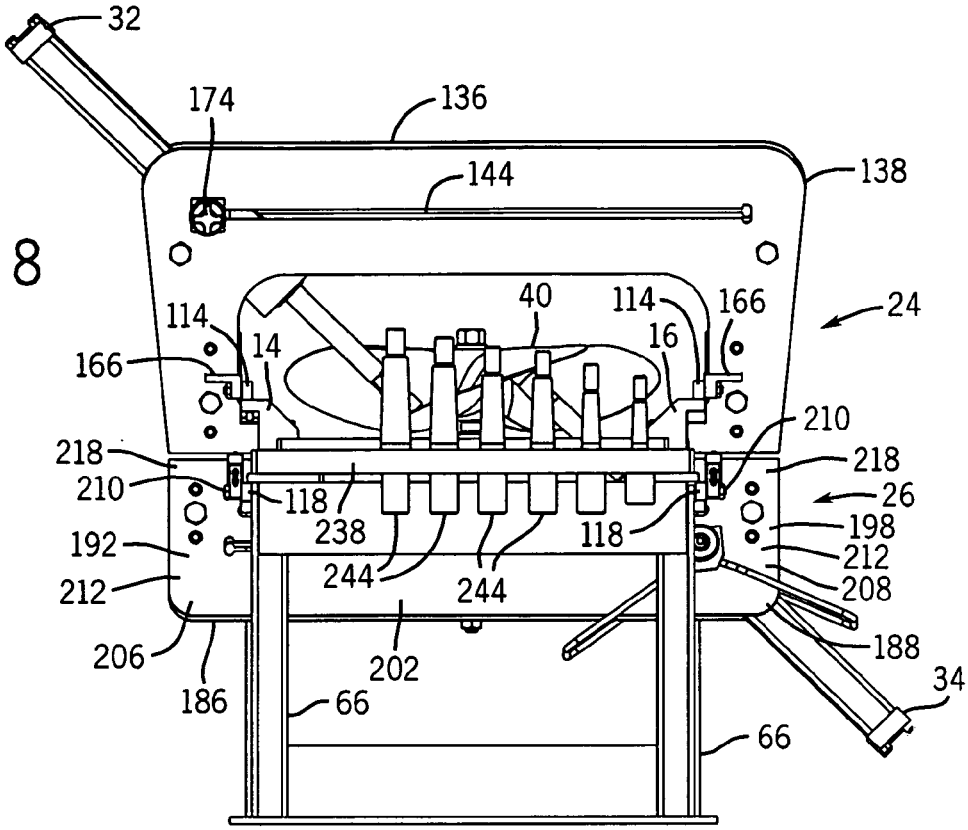
FIG. 8 is a left end view of the apparatus of FIG. 1.
Figure 9:
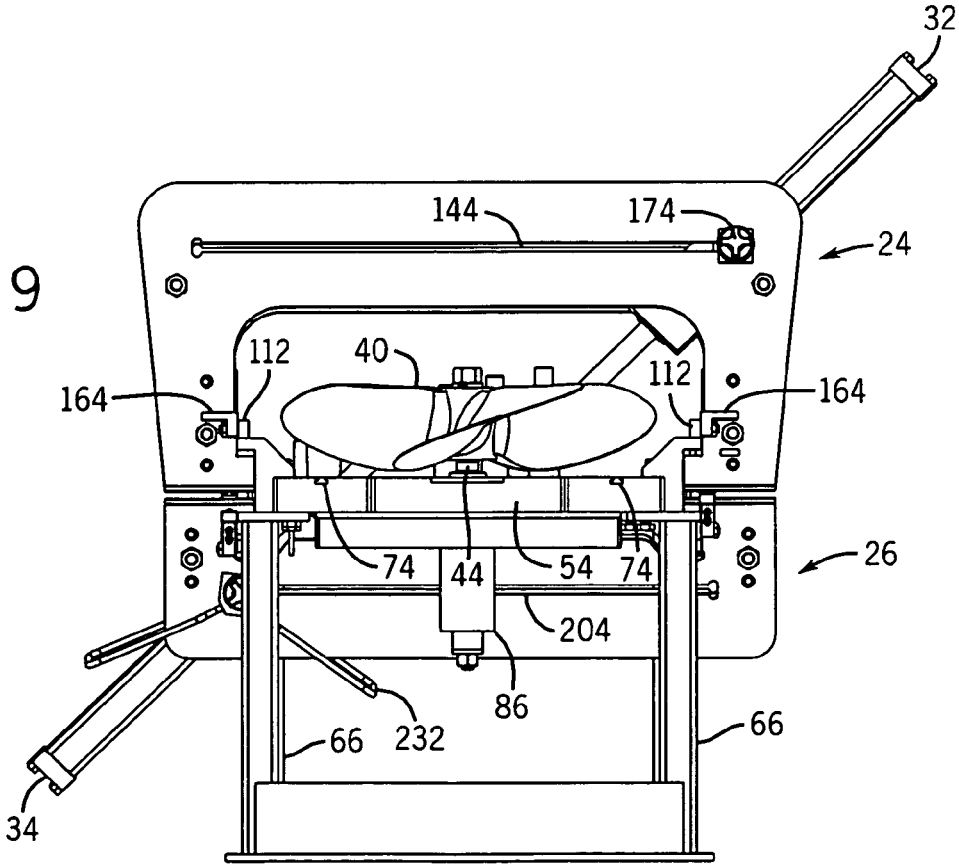
FIG. 9 is a right end view of the apparatus of FIG. 1.
Figure 10:
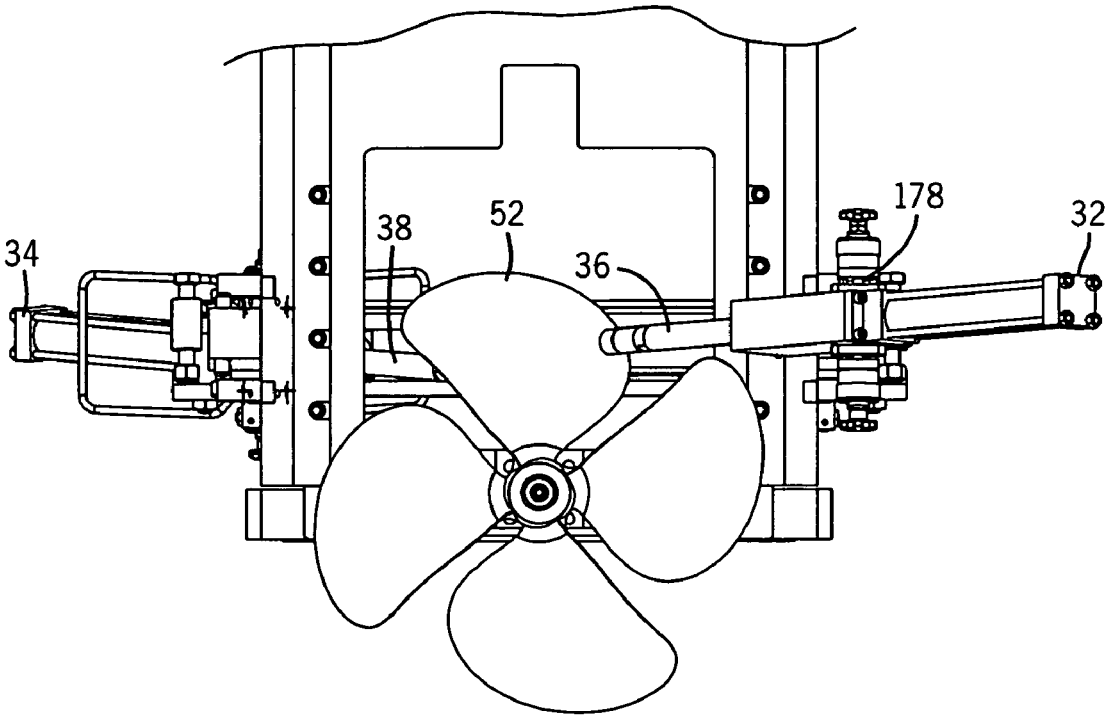
FIG. 10 is a top view of the apparatus of FIG. 1 with the top frame removed.
Figure 11:
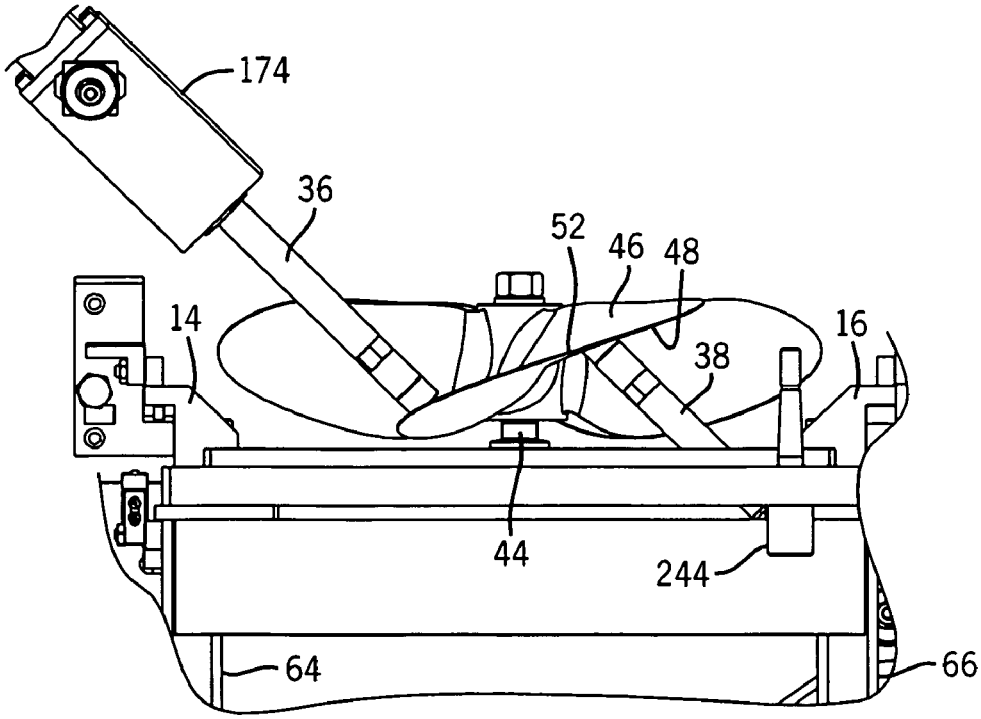
FIG. 11 is an enlarged left end view of the apparatus of FIG. 1 with some of the spare tapered shafts and both frames removed.
Figure 14:
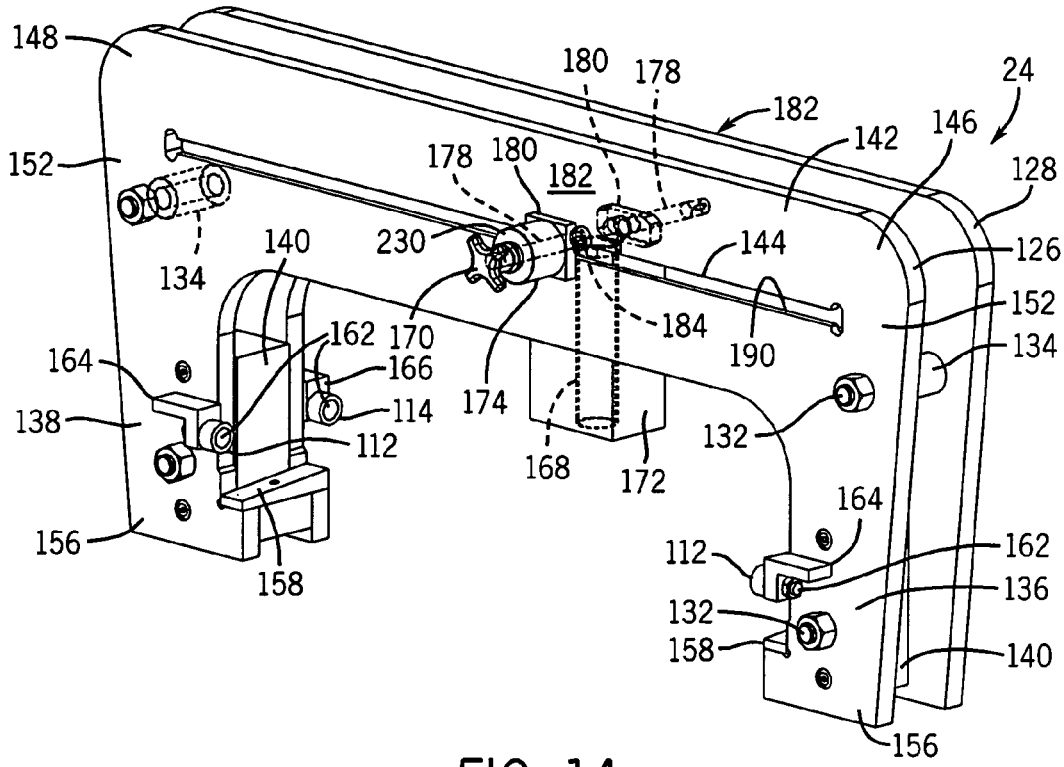
FIG. 14 is a right perspective view of the upper frame of FIG. 1.
Figure 15:
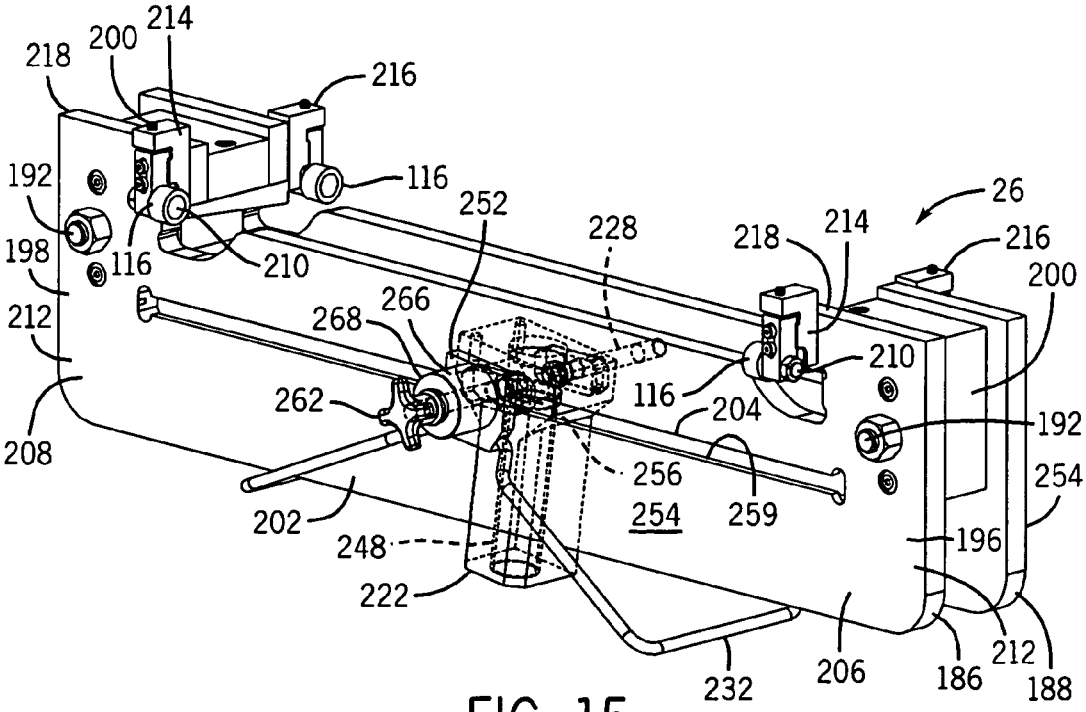
FIG. 15 is a right perspective view of the lower frame of FIG. 1.

A preferred embodiment of a propeller repair apparatus 10 shown in FIGS. 1-11 includes a work table 12 supporting a pair of parallel horizontal rails 14, 16. Upper and lower frames 24, 26 movably mounted on the rails 14, 16 support upper and lower opposing actuators 32, 34. Each actuator 32, 34 includes a ram 36, 38 engageable with a propeller 40 mounted on a tapered shaft 44 extending upwardly between the rails 14, 16. Advantageously, the rams 36, 38 are independently positionable relative to the propeller 40 to engage opposite surfaces 46, 48 of a propeller blade 52 of the propeller 40 to repair the propeller 40 and/or change the pitch of the blade 52.

As shown in FIGS. 1-12, the work table 12 includes a horizontal work platform 54 having front and rear sides 56, 58 joined by right and left ends 62, 64. The work platform 54 is supported above the floor by legs 66 extending downwardly from each work platform corner 68. The lower actuator ram 38 extends through an opening 72 formed through the work platform 54 to engage a downwardly facing surface 48 of the blade 52 forming part of the propeller 40 mounted on the tapered shaft 44. Clamp T-slots 74 formed in an upper surface 76 of the work platform 54 on opposing sides of the opening 72 can be provided for mounting clamps or jigs to the work platform 54. Advantageously, the work platform 54 provides a convenient surface for placing tools and the like when setting up the apparatus 10 for working on the propeller 40.

The tapered shaft 44 extends upwardly along a tapered shaft axis 78 from the work platform 54 between the opening 72 and the right end 62 of the work platform 54. Preferably, as shown clearly in FIG. 12, the tapered shaft 44 includes a longitudinal blind threaded hole 50 open to a bottom end 60 of the tapered shaft 44. A threaded stub 70 extending upwardly from an upper end 80 of the tapered shaft 44 threadably engages a prop nut 88 to secure the propeller 40 on the tapered shaft 44. The blind threaded hole 50 threadably engages a threaded ram 84 extending upwardly from a hold down actuator 86 mounted to the work platform 54.

The propeller 40 is secured relative to the upper and lower frames by threadably engaging the tapered shaft blind threaded hole 50 with the threaded ram 84. The propeller 40 is slipped onto the tapered shaft 44 and secured thereto by the prop nut 88 threadably engaging the threaded stub. The prop nut 88 urges the propeller 40 tightly onto the tapered shaft 44. The hold down actuator 86 is then actuated to retract the threaded ram 84 and draw the tapered shaft 44, downwardly toward, and securely against, the work platform 54.

Referring back to FIGS. 1-11, the parallel rails 14, 16 movably support the upper and lower frames 24, 26 for movement across the opening 72 between the work platform ends 62, 64. Each rail 14, 16 is mounted to one side 56, 58 of the work platform 54 using methods known in the art, such as bolts, welding, and the like, and includes outwardly extending upper and lower flanges 92, 94. In a preferred embodiment, each rail 14, 16 includes an inner channel 96 that receives one side 56, 58 of the work platform 54 to mount the rail 14, 16 to the work platform 54, and an upper and lower inner edge 102, 104 of each rail 14, 16 is tapered. Advantageously, tapering the upper inner edge 102 of each rail 14, 16 provides clearance between the rail 14, 16 and the propeller 40 mounted on the tapered shaft 44. In addition, tapering the lower inner edge 104 of each rail 14, 16 provides clearance for the lower actuator 34 at extreme outward settings (i.e. a lower actuator 34 position close to one of the rails 14, 16).

Each rail upper and lower flange 92, 94 includes a substantially horizontal upper surface 106, 108 extending substantially perpendicular to the tapered shaft axis 78. Each flange upper surface 106, 108 engages rollers 112, 114, 116, 118 mounted to one of the upper and lower frames 24, 26 to movably support the upper and lower frames 24, 26 relative to the work platform 54. In a preferred embodiment, the upper flange 92 also includes a lower surface 122 that engages the upper frame 24 to lock the upper frame 24 in position when the upper actuator 32 is actuated.

As shown in FIGS. 1-11 and 14, the upper frame 24 supports the upper actuator 32 above the work platform 54, and is movably mounted on the rails 14, 16 for movement along the rails 14, 16 between the work platform ends 62, 64. In a preferred embodiment, the upper frame 24 includes a pair of spaced apart parallel plates 126, 128 joined together by bolts 132 extending through cylindrical spacers 134 and spacing blocks 140. The spacers 134 and spacing blocks 140 space the plates 126, 128 a predetermined distance that allows the upper actuator 32 to fit therebetween. Although an upper frame 24 formed from spaced plates 126, 128 is preferred, any frame structure, such as formed from beams, tubes, and the like, that can support the upper actuator 32 can be used without departing from the scope of the invention.

Each upper frame plate 126, 128 has a pair of legs 136, 138 supporting a cross member 142 above the work platform 54. Each upper frame plate cross member 142 includes a slot 144 extending between the legs 136, 138 that slidably mounts the upper actuator 32 for slidable movement between the rails 14, 16. Each upper frame plate leg 136, 138 extends downwardly from one end 146, 148 of the upper frame plate cross member 142 toward one of the rails 14, 16 to support the upper frame plate cross member 142 above the work platform 54. Preferably, the cross member 142 and legs 136, 138 of each upper frame plate 126, 128 are formed as an integral piece, such as cut from a single steel plate.

Each upper frame plate leg 136, 138 has an upper end 152 supporting the upper frame plate cross member 142 and a lower end 156 movably mounted on one of the rails 14, 16. Preferably, a roller 112, 114 rotatably mounted to each upper frame plate 126, 128 proximal the lower end 156 engages the upper surface 106 of the upper flange 92 to movably mount the legs 136, 138, and thus the upper frame 24, on the rails 14, 16 for movement between the work platform ends 62, 64 above the opening 72 in the work platform 54. A hook 158 extending inwardly from each leg lower end 156 beneath the upper flange 92 engages the lower surface 122 of the upper flange 92 when actuating the upper actuator 32 and engaging the upper actuator ram 36 with the propeller blade 52 to lock the upper frame 24 in place while repairing the propeller 40 or changing the propeller blade pitch.

In a preferred embodiment, each roller 112, 114 engaging the upper flange upper surface 106 is rotatably mounted on an axle 162 extending inwardly from a bracket 164, 166 fixed to one of the upper frame plates 126, 128. Preferably, the brackets 164 on one upper frame plate 126 and spaced from the upper end 152 of each leg 136, 138 a distance different from the brackets 166 on the other upper frame plate 128 to movably mount the upper frame 24 at a non-perpendicular angle A relative to the upper flange upper surface 106, and thus an acute angle relative the tapered shaft axis 78. Advantageously, movably mounting the upper frame 24 at an angle A (shown in FIG. 7) allows the upper actuator 32 to engage the propeller blade 52 at an angle more closely approximating the angle of the blade 52 of the propeller 40 mounted on the vertical shaft 44. In the embodiment disclosed herein, the brackets 164, 166 are fixed to the upper frame plates 126, 128, using methods known in the art, such as welding. Of course, the brackets 164, 166 can be detachably fixed relative to the upper frame plates 126, 128, using mechanical fasteners, such as bolts, to adjust the angle A of the upper frame 24 without departing from the scope of the invention.

The upper actuator 32 is pivotally mounted to the upper frame 24 between the upper frame plate cross members 142 and movable between the rails 14, 16 to position the upper actuator ram 36 at a desired location on the propeller 40.

Preferably, the upper actuator 32 is a double acting hydraulic cylinder that allows controlled extension and retraction of the upper actuator ram 36. Hydraulic hoses supplying hydraulic fluid to the upper actuator 32 and other hydraulic components are not shown to provide a clear view of the apparatus components. Of course, one skilled in the art can route hydraulic hoses to the upper actuator 32, as desired, without interfering with the operation of the apparatus 10. Moreover, other actuators, such as single acting hydraulic cylinders, screw jacks and the like, can be used without departing from the scope of the invention.

The upper actuator 32 is fixed to one end of an upper actuator mounting block 172 slidably mounted between the upper frame plate cross members 142 which pivotally mounts the upper actuator 32 relative to the upper frame plate cross members 142, and thus the upper frame 24. The upper actuator extends through a longitudinal through hole 168 formed through the upper actuator mounting block 172. In one embodiment, a bronze bushing (not shown) disposed in the through hole 168 supports radial loads acting on the upper actuator ram 36, such as caused by side loading and upper actuator ram 36 bending, to protect bearings and seals within the upper actuator 32 and minimizes friction between the upper actuator ram 36 and the upper actuator mounting block 172. Upper pivot rods 178 (shown in FIG. 10) extending from opposite sides of the upper actuator mounting block 172 through the slots 144 formed through each upper frame plate cross member 142 define the pivot axis 176 (shown in FIG. 7) of the upper actuator 32. A handle 170 fixed to the exposed end 220 of each upper pivot rod 178 provides a grasping point for moving the upper actuator mounting block 172, and thus the upper actuator 32, between the rails 14, 16.

A slide block 180 axially slidably mounted on each pivot rod 178 adjacent an outwardly facing surface 182 of each upper frame plate 126, 128 engages the respective upper frame plate 126, 128 to fix the upper actuator mounting block 172, and thus the upper actuator 32, relative to the upper frame 24 when working on the propeller 40. Preferably, a roller 184 rotatably mounted on an axle (not shown) extending inwardly from at least one of the slide blocks 180 engages a lower surface 190 of the adjacent slot 144 to reduce the effort necessary to slide the upper actuator mounting block 172 between the rails 14, 16.

When working on the propeller 40, the upper actuator mounting block 172, and thus the upper actuator 32, is rigidly fixed to the upper frame 24 by two opposing upper hydraulic clamps 174. Each upper hydraulic clamp 174 is fixed to one of the upper pivot rods 178, and includes a clamp hydraulic actuator 230 which urges one of the slide blocks 180 axially into engagement with the adjacent upper frame plate 126, 128 to secure the upper actuator mounting block 172 relative to the upper frame 24 at a desired angle and position along the upper frame plate cross members 142. Advantageously, the upper hydraulic clamps 174 can be fixed to the respective upper pivot rod 178 using methods known in the art, such as threadably engaging the upper hydraulic clamp 174 with a threaded portion of the upper pivot rod 178, welding the upper hydraulic clamp 174 to the upper pivot rod 178, and the like, without departing from the scope of the invention. Moreover, although hydraulic clamps are disclosed, the clamps disclosed herein can be any known clamp suitable for the particular application. For example, pneumatic or manual clamps may be used if the anticipated forces generated by the actuators engaging the propeller dictate that hydraulic clamps are not necessary.

As shown in FIGS. 1-11 and 15, the lower frame 26 supports the lower actuator 34 below the work platform 54, and is movably mounted on the rails 14, 16 for movement along the rails 14, 16 between the work platform ends 62, 64. In a preferred embodiment, the lower frame 26 includes a pair of spaced apart parallel plates 186, 188 joined together by bolts 192 extending through spacer blocks 200. The spacer blocks 200 space the lower frame plates 186, 188 a predetermined distance that allows the lower actuator 34 to fit therebetween. Although a lower frame 26 formed from spaced plates 186, 188 is preferred, any frame structure, such as formed from beams, tubes, and the like, that can support the lower actuator 34 can be used without departing from the scope of the invention.

Each lower frame plate 186, 188 has a pair of legs 196, 198 supporting a cross member 202 beneath the work platform 54. Each lower frame plate cross member 202 includes a slot 204 extending between the legs 196, 198 that slidably mounts the lower actuator 34 for slidable movement between the rails 14, 16. Each lower frame plate leg 196, 198 extends upwardly from one end 206, 208 of the lower frame plate cross member 202 toward one of the rails 14, 16 to support the lower frame plate cross member 202 beneath the work platform 54. Preferably, the cross member 202 and legs 196, 198 of each lower frame plate 186, 188 are formed as an integral piece, such as cut from a single steel plate.

Each lower frame plate leg 196, 198 has a lower end 212 supporting the lower frame plate cross member 202 and an upper end 218 movably mounted to one of the rails 14, 16. Preferably, a roller 116, 118 rotatably mounted to each lower frame plate 186, 188 proximal the upper end 218 engages the upper surface 108 of the lower flange 94 of the rails 14, 16 to movably mount the legs 196, 198, and thus the lower frame 26, on the rails 14, 16 for movement between the work platform ends 62, 64 beneath the opening 72 in the work platform 54.

In a preferred embodiment, each roller 116, 118 engaging the lower flange upper surface 108 is rotatably mounted on a spring loaded axle 210 extending inwardly from a bracket 214, 216 fixed to one of the lower frame plates 186, 188. Preferably, the brackets 214 on one lower frame plate 186 are spaced from the lower end 212 of each leg 196, 198 a distance different from the brackets 216 on the other lower frame plate 188 to movably mount the lower frame 26 at a non-perpendicular angle B (shown in FIG. 7) relative to the lower flange upper surface 108, and thus an acute angle relative to the tapered shaft axis 78. Advantageously, movably mounting the lower frame 26 at an angle B allows the lower actuator 34 to engage the propeller blade 52 at an angle more closely approximating the angle of the blade 52 of the propeller 40 mounted on the vertical shaft 44. In the embodiment disclosed herein, the brackets 214, 216 are fixed to the lower frame plates 186, 188, using methods known in the art, such as welding. Of course, the brackets 214, 216 can be detachably fixed relative to the lower frame plates 186, 188, using mechanical fasteners, such as bolts, to adjust the angle B of the lower frame without departing from the scope of the invention.

The lower actuator 34 is pivotally mounted to the lower frame 26 between the lower frame plate cross members 202 and movable between the rails 14, 16 to position the lower actuator ram 38 at a desired location on the propeller 40. Advantageously, the lower actuator 34 is pivotable independent of the upper actuator 32 which allows the lower actuator 34 to impart a force on the blade 52 in a direction not parallel to the force imparted by the upper actuator 32. Preferably, the lower actuator 34 is a double acting hydraulic cylinder that allows controlled extension and retraction of the lower actuator ram 38. Hydraulic hoses supplying hydraulic fluid to the lower actuator 34 are not shown to provide a clear view of the apparatus components. Of course, one skilled in the art can route hydraulic hoses to the lower actuator 34, as desired, without interfering with the operation of the apparatus 10. Moreover, other actuators, such as single acting hydraulic cylinders, screw jacks and the like, can be used without departing from the scope of the invention.

The lower actuator 34 is fixed to one end of a lower actuator mounting block 222 slidably mounted between the lower frame plate cross members 202 which pivotally mounts the lower actuator 34 relative to the lower frame plate cross members 202, and thus the lower frame 26. The lower actuator 34 extends through a longitudinal through hole 248 formed through the lower actuator mounting block 222. In one embodiment, a bronze bushing (not shown) disposed in the through hole 248 supports radial loads acting on the lower actuator ram 38, such as caused by side loading and lower actuator ram 38 bending, to protect bearings and seals within the lower actuator 34 and minimizes friction between the lower actuator ram 38 and lower actuator mounting block 222. Lower pivot rods 228 (shown in FIG. 5) extending from opposing sides of the lower actuator mounting block 222 through the slots 204 formed through each lower frame plate cross member 202 define the pivot axis 226 (shown in FIG. 7) of the lower actuator 34.

Figure 16:
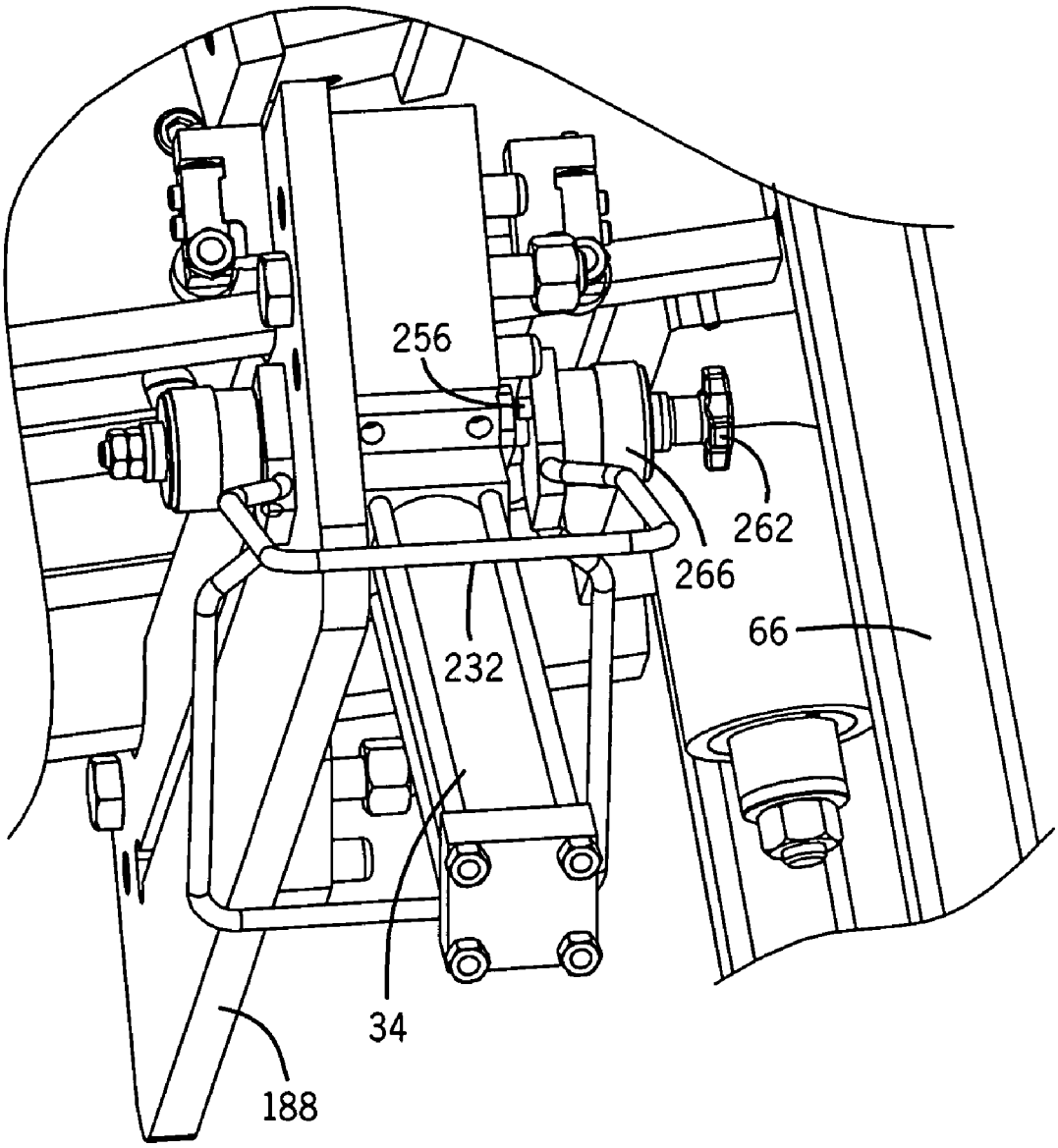
FIG. 16 is a detailed view of the lower frame of FIG. 1 with one lower frame plate removed.

A lower slide block 252 slidably mounted on each lower pivot rod 228 adjacent an outwardly facing surface 254 of each lower frame plate 186, 188 engages the respective lower frame plate 186, 188 to fix the lower actuator mounting block 222, and thus the lower actuator 34, relative to the lower frame 26 when working on the propeller 40. Preferably, a roller 256, shown best in FIG. 16, rotatably mounted on an axle (not shown) extending inwardly from at least one of the slide blocks 252 engages a lower surface 259 of the adjacent slot 204 to reduce the effort necessary to slide the lower actuator mounting block 222 between the rails 14, 16. A handle 262 fixed to the exposed end 264 of each lower pivot rod 228 provides a grasping point for moving the lower actuator mounting block 222, and thus the lower actuator 34, between the rails 14, 16.

When working on the propeller 40, the lower actuator mounting block 222, and thus the lower actuator 34, is rigidly fixed to the lower frame 26 by two opposing lower hydraulic clamps 266. Each lower hydraulic clamp 266 is fixed to one of the lower pivot rods 228, and includes a clamp hydraulic actuator 268 which urges one of the slide blocks 252 into engagement with the adjacent lower frame plate 186, 188 to secure the lower actuator mounting block 222 relative to the lower frame 26 at a desired angle and position along the lower frame plate cross members 202. Advantageously, the lower hydraulic clamps 266 can be fixed to the respective lower pivot rod 228 using methods known in the art, such as threadably engaging the lower hydraulic clamp 266 with a threaded portion of the lower pivot rod 228, welding the lower hydraulic clamp 266 to the lower pivot rod 228, and the like, without departing from the scope of the invention. Moreover, although hydraulic clamps are disclosed, the clamps disclosed herein can be any known clamp suitable for the particular application. For example, pneumatic or manual clamps may be used if the anticipated forces generated by the actuators engaging the propeller dictate that hydraulic clamps are not necessary.

In the embodiment shown herein, handles 232 rigidly fixed relative to the lower slide blocks allow a user to easily pivot the lower actuator mounting block 222 about a rotational axis of the lower slide block rollers 256 to move the lower actuator mounting block 222, and thus the lower actuator 34 between the rails 14, 16 relative to the lower frame 26. Although the handles 232 are shown for moving the lower actuator 34 relative to the lower frame 26, the handles 232 can be omitted without departing from the scope of the invention.

A shaft tray 238, shown in FIGS. 1-11, fixed to the left end 64 of the work platform 54 includes a plurality of holes 242 for storing additional tapered shafts 244 for use with the threaded ram 84 extending upwardly from the hold down actuator 86. Preferably, the additional tapered shafts 244 have different diameter ranges for use with different sized propellers.

In use, the tapered shaft 44 suitable for use with the propeller 40 being repaired is selected from the shaft tray 238 and fixed to the threaded ram 84 extending upwardly from the hold down actuator 86. The propeller 40 is then slipped onto the tapered shaft 44 with the blade 52 being repaired positioned over the opening 72 formed in the work platform 54. The prop nut 88 is threaded onto the threaded stub 70 extending upwardly from the tapered shaft 44 to secure the propeller 40 to the tapered shaft 44. The hold down actuator 86 is then actuated to draw the tapered shaft 44 downwardly against the work platform 54.

Once the propeller 40 is positioned and secured, the upper frame 24 is moved over the propeller blade 52 to align the upper actuator 32 with a plane containing a desired location on the upwardly facing surface 46 of the propeller blade 52 extending over the opening 72 formed in the work platform 54. The upper actuator ram 36 is then aligned with the desired location on the upwardly facing surface 46 of the propeller blade 52 by sliding the upper actuator 32 parallel to the upper frame plate cross members 142 and/or pivoting the upper actuator 32 above the upper actuator pivot axis 176. The upper actuator 32 is then actuated to extend the upper actuator ram 36 into engagement with the propeller blade 52 and lift the upper frame 24 to engage the upper frame plate hooks 158 with the lower surface 122 of the upper flanges 92 of the rails 14, 16 and hold the upper frame 24 in place.

Once the upper frame 24 is secured in place, the lower frame 26 is moved beneath the propeller blade 52 to align the lower actuator 34 with a plane containing a desired location on a downwardly facing surface 48 the propeller blade 52 extending over the opening 72 formed in the work platform 54. The lower actuator ram 38 is then aligned with the desired location on the downwardly facing surface 48 of the propeller blade 52 by sliding the lower actuator 34 parallel to the lower frame plate cross members 202 and/or pivoting the lower actuator 34 above the lower actuator pivot axis 226. The lower actuator 34 is then actuated to extend the lower actuator ram 38 into engagement with the propeller blade 52 at the desired location on the downwardly facing surface 48 of the propeller blade 52.

Once both the upper and lower actuator rams 36, 38 are engaging the propeller blade 52, one or both of the actuators 32, 34 are actuated to urge the propeller blade 52 in a desired direction to repair the blade 52 or change the blade pitch. Advantageously, the upper and lower actuators 32, 34 can be easily disengaged and moved to different locations on the blade 52 by repeating the above steps.

The present invention is not limited to the above described applications, and one skilled in the art will be able to incorporate the present invention into other applications that fall within the scope of the claims. Moreover, while there has been shown and described what is at present considered the preferred embodiment of the invention, it will be obvious to those skilled in the art that various changes and modifications can be made therein without departing from the scope of the invention defined by the appended claims.

We claim:

1. A propeller repair apparatus suitable for repairing and changing the pitch of a propeller, said apparatus comprising:

a first rail;

a second rail spaced from said first rail and parallel to said first rail;

a tapered shaft extending upwardly between said first and second rails for mounting a propeller thereon;

a first frame extending between said first and second rails, said frame being movably mounted on said first and second rails for movement along said first and second rails, and a first actuator pivotally mounted to said first frame, said first actuator including an extendible ram engagable with a propeller mounted on said tapered shaft;

a second frame extending between said first and second rails, said second frame being movably mounted on said first and second rails for movement along said first and second rails; and a second actuator pivotally mounted to said second frame, said second actuator including an extendible ram engagable with a propeller mounted on said tapered shaft.

2. The apparatus as in claim 1, in which said first actuator is movably mounted to said first frame for movement between said first and second rails.

3. The apparatus as in claim 1, in which said first actuator is mounted above said rails, and said second frame is mounted below said rails.

4. The apparatus as in claim 1, in which said second actuator is movably mounted to said second frame for movement between said first and second rails.

5. The apparatus as in claim 1, including a work platform extending between said first and second rails.

6. The apparatus as in claim 1, in which said tapered shaft defines an axis, and said first frame defines an acute angle relative to said axis.

7. The apparatus as in claim 1, in which at least one of said first frame and said second frame includes a pair of spaced parallel plates, and said first actuator is disposed between said plates.

8. The apparatus as in claim 1, including a work platform extending between said first and second rails.

9. The apparatus as in claim 1, in which said first and second rails are horizontal.

10. A propeller repair apparatus suitable for repairing and changing the pitch of a propeller, said apparatus comprising:

a first rail;

a second rail spaced from said first rail and parallel to said first rail;

a tapered shaft extending upwardly between said first and second rails for mounting a propeller thereon;

an upper frame extending between said first and second rails above said tapered shaft, said upper frame being movably mounted on said first and second rails for movement along said first and second rails;

an actuator movably mounted to said upper frame for movement between said first and second rails, said actuator including an extendible ram engagable with a propeller mounted on said tapered shaft;

a second frame extending between said first and second rails, said second frame being movably mounted on said first and second rails for movement along said first and second rails; and a second actuator movably mounted to said second frame, said second actuator including an extendible ram engagable with a propeller mounted on said tapered shaft.

11. The apparatus as in claim 1, in which said actuator is pivotally mounted to said upper frame.

12. The apparatus as in claim 10, in which said first actuator is mounted above said rails, and said second frame is mounted below said rails.

13. The apparatus as in claim 10, in which said second actuator is pivotally mounted to said second frame for movement between said first and second rails.

14. The apparatus as in claim 10, including a work platform extending between said first and second rails.

15. The apparatus as in claim 10, in which said tapered shaft defines an axis, and said first frame defines an acute angle relative to said axis.

16. The apparatus as in claim 10, in which at least one of said upper frame and said second frame includes a pair of spaced parallel plates, and said first actuator is disposed between said plates.

17. The apparatus as in claim 10, including a work platform extending between said first and second rails.

18. The apparatus as in claim 10, in which said first and second rails are horizontal.

* * * * *